US005257839A

United States Patent [19]

Nielsen et al.

[11] Patent Number: 5,257,839

[45] Date of Patent: Nov. 2, 1993

[54] TENSION LATCH ASSEMBLY

[75] Inventors: Raymond A. Nielsen, Sterling; Cordell E. Meiste, Morrison; Dennis J. Rooney, Sterling, all of Ill.

[73] Assignee: National Manufacturing Co., Sterling, Ill.

[21] Appl. No.: 875,986

[22] Filed: Apr. 29, 1992

Related U.S. Application Data

[63] Continuation-in-part of Ser. No. 712,452, Jun. 10, 1991, abandoned.

[51] Int. Cl.[5] ..... E05C 5/00

[52] U.S. Cl. ..... 292/113; 297/247; 297/205; 297/DIG. 49; 297/104

[58] Field of Search ..... 292/113, 104, 66, DIG. 31, 292/DIG. 53, DIG. 49, 205

[56] References Cited

U.S. PATENT DOCUMENTS

| | | | |
|---|---|---|---|
| 2,732,238 | 7/1956 | Dornberg . | |
| 2,874,987 | 2/1959 | Cole | 292/247 |
| 2,971,722 | 9/1960 | Swanson | 292/247 |
| 2,998,272 | 8/1961 | Newcomer | 292/247 |
| 3,008,320 | 9/1961 | Cheney . | |
| 3,030,137 | 4/1962 | Cheney . | |
| 3,174,784 | 10/1965 | Swanson . | |
| 3,321,230 | 5/1967 | Stollman . | |
| 3,519,298 | 7/1970 | Grey et al. . | |
| 3,630,559 | 12/1971 | Rawson . | |
| 3,706,467 | 12/1972 | Martin | 292/247 |
| 3,873,142 | 3/1975 | Reid . | |
| 3,998,481 | 12/1976 | Anthone . | |
| 4,181,333 | 1/1980 | Stelma . | |
| 4,268,073 | 5/1981 | Hibbert . | |
| 4,638,649 | 1/1987 | Chao . | |
| 4,890,869 | 1/1990 | Langkamp, Jr. | 292/247 |
| 4,951,983 | 8/1990 | Scott . | |
| 5,040,834 | 8/1991 | Kahl . | |

FOREIGN PATENT DOCUMENTS

| | | | |
|---|---|---|---|
| 612104 | 10/1926 | France . | |
| 1243810 | 9/1960 | France . | |
| 391256 | 5/1972 | France . | |
| 133593 | 10/1919 | United Kingdom | 292/247 |

*Primary Examiner*—Eric K. Nicholson

*Attorney, Agent, or Firm*—Tilton, Fallon, Lungmus & Chestnut

[57] ABSTRACT

A latch incorporates a latch member in the form of a leaf spring which is connected by an overcenter operating lever mechanism to a case mounted to a door for latching engagement with a strike mounted to another door or frame member. The strike incorporates guide rails for guiding the latch member into engagement with the strike, and the case includes an upstanding part for receiving a part of a lock with another part of the lock extending through an opening in the lever mechanism.

5 Claims, 4 Drawing Sheets

TENSION LATCH ASSEMBLY

This application is a continuation in part of our copending application Ser. No. 712,452, filed Jun. 10, 1991 now abandoned.

The present invention relates in general to latch assemblies of the type used to lock doors or the like to associated frames or to other doors and it relates, in particular, to a new and improved latch assembly or hasp which incorporates a leaf spring and an over center mechanism for locking the latch sub-assembly or hasp to a strike.

BACKGROUND AND SUMMARY OF INVENTION

Latch assemblies of the type used for latching swinging gates to adjacent frame members and for latching two doors or gates to one another are well known in the prior art as exemplified by Pat. Nos. 3,030,137 and 3,998,481. Also, it is well known to use padlocks to lock such hasps to the associated strikes. One problem with the prior art latch assemblies has been the ease with which the locks can be cut or broken and then removed to unlock the associated door. Also, it has not been difficult to pry the prior art type of hasps away from the strikes using heavy screwdrivers or crowbars.

Another problem with many of the hasps now on the market is the difficulty of aligning the hasps with the associated strikes when the door or gate is to be locked. This is particularly true after the door or gate has been in use for some time and the door or gate has sagged such that the hasp and the strike are no longer perfectly aligned with one another.

Briefly, in accordance with the present invention there is provided a new and improved latch sub-assembly which is sturdy in construction and which includes a case, a lever and a latch in superposed, nested relation to provide, in effect, a rectangular solid. More particularly, the inventive latch sub-assembly incorporates an over center latching mechanism which includes an imperforate leaf spring. This spring, in the locking position covers both the operating mechanism of the latch and the fasteners which are used to mount the latch and the strike to the members to be locked together. In this manner surreptitious disassembly of the latch from the associated strike and from the door and frame is prevented. The remainder of the operating mechanism is covered by an imperforate handle which is a part of a lever which is used to operate the latch.

BRIEF DESCRIPTION OF THE DRAWINGS

A better understanding of the present invention may be had from a reading of the following detailed description taken in connection with the accompanying detailed description taken in connection with the accompanying drawings wherein.

DETAILED DESCRIPTION

Figure 1:
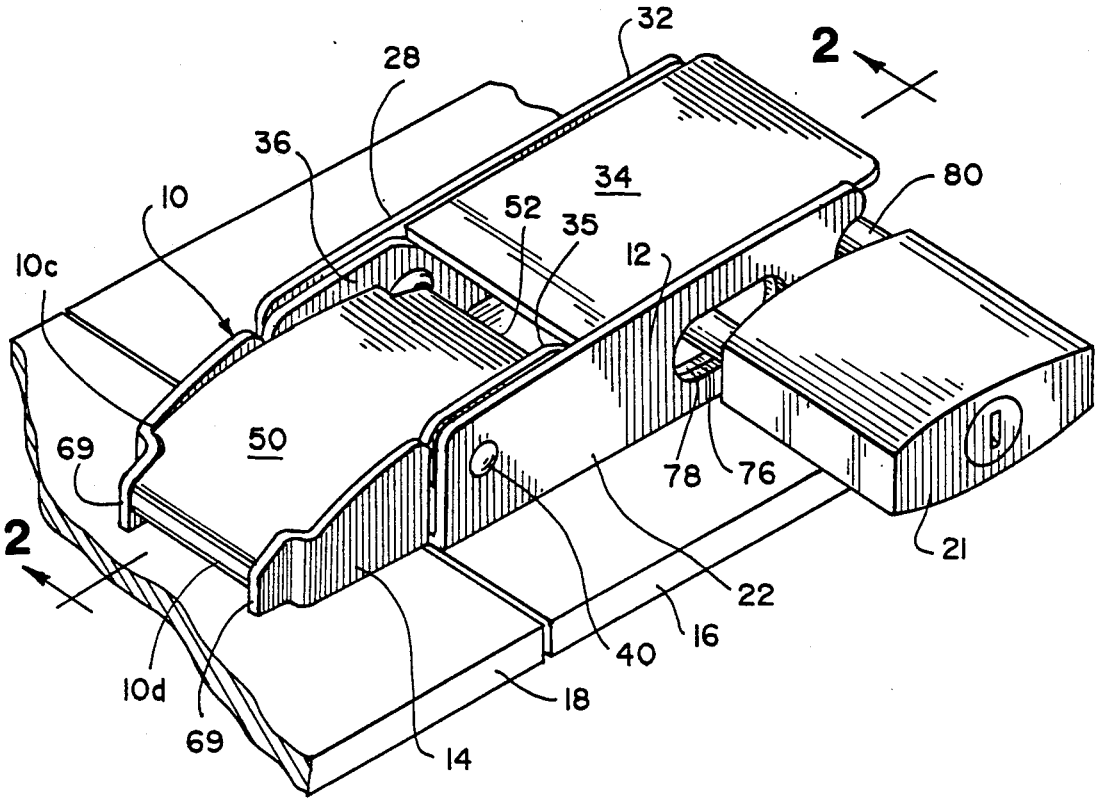
FIG. 1 is a perspective view of the inventive latch sub-assembly and associated strike in the latched position.
Figure 2:
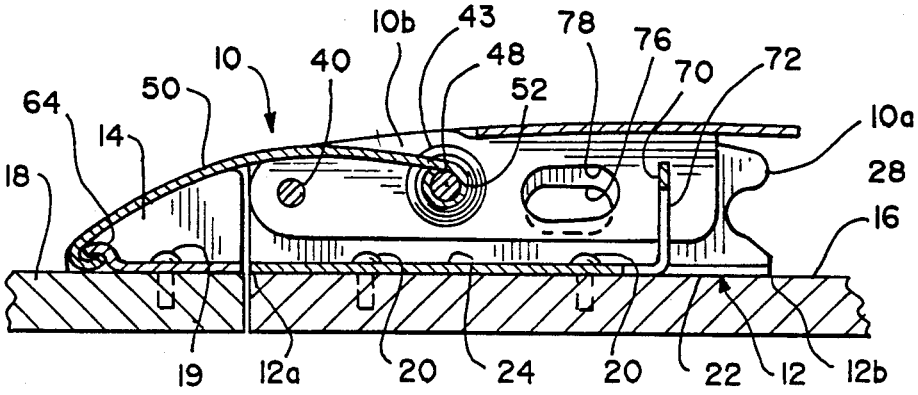
FIG. 2 is a longitudinal cross-sectional view of the latch sub-assembly and strike of FIG. 1 taken along the line 2—2 of FIG. 1.
Figure 3:
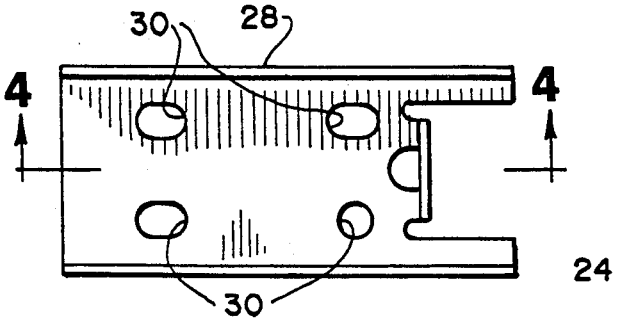
FIG. 3 is a plan view of the case of the latch assembly shown in FIG. 1.

Referring particularly to FIGS. 1-3 there is shown a latch assembly 10 which includes a relatively elongated latch sub-assembly 12 and a strike 14 arranged in longitudinally aligned relation. The latch sub-assembly is affixed to the face of a member 16 (such as a door, gate, frame, etc.) by means of a plurality of mounting fasteners 20, and the strike 14 is affixed to the face of a companion member 18 by means of a plurality of mounting fasteners 19. One or both of the members 16 and 18 may be a door, gate or frame which is adapted to be locked to the other member by the latch assembly 10. It will be seen that the faces of the members 16 and 18 to which the strike 14 and the latch sub-assembly 12 are respectively mounted are in substantially coplanar relationship. The sub-assembly 12 has proximal end 12*a* adjacent the strike 14 and a distal end 12*b* remote from the strike 14. In this embodiment, a padlock 21 is used to lock the latch sub-assembly 12 in the latching position.

The latch sub-assembly 12 includes a unitary relatively elongated case member 22 having a planar base or bight 24 connected to a pair of upstanding side flanges 26 and 28, to provide a U-shape in transverse section. The case is shown in its entirety in FIGS. 3, 4 and 5 and may be seen to include a plurality of suitable holes 30 provided in the bight 24 to accommodate the fasteners 20. Four such holes are provided and three of them are elongated to facilitate adjusted of the position of the latch sub-assembly on the member 16 and the fourth is circular to lock the case in the adjusted position.

A relatively elongated latching lever 32 also having a U-shape in transverse section is shown in its entirety in FIGS. 6, 7, 8 and 9. It includes a relatively flat operating handle or bight 34 extending over only a portion of the length of the lever from the distal end thereof. The handle 34 is permanently attached to a pair of depending arms or flanges 35 and 36 which are disposed in proximity to the inner faces of the side flanges of the case 22. It will be noted that the latching lever 32 is nested within the case 22 but the U-shape is inverted. The arms 35 and 36 at their proximal ends are provided with aligned holes 38 which freely receive a pintle 40 mounted at its ends in the flanges 26 and 28.

A pair of embossments 42 and 43 on the arms 35 and 36 are provided with central holes 45 and 46 which receive a pivot pin 48, best shown in FIG. 2, on which a spring latch 50 is pivotally mounted.

Figure 10:
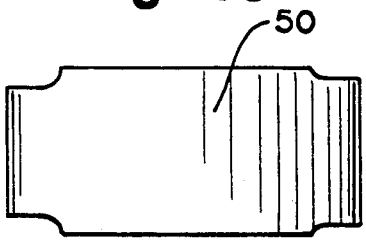
FIG. 10 is a plan view of the spring latch member used in the latch assembly.
Figure 15:
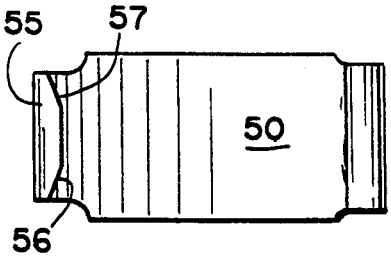
FIG. 15 is a bottom view of the spring latch shown in FIG. 10.
Figure 11:
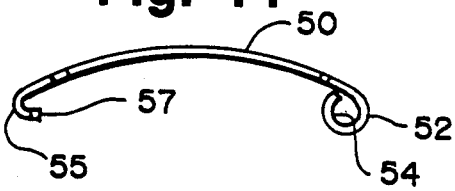
FIG. 11 is an elevational view taken from the bottom of the latch as it is illustrated in FIG. 1O.

The latch 50 is shown in its entirety in FIGS. 10 and 11 and may be seen to be a generally arcuate plate which is rolled at the end 52 thereof to define a cylindrical transverse hole 54 through which the pivot pin 48 is adapted to freely extend.

The other end 55 of the latch is partially curled back upon itself to provide a hook which is adapted to engage and grasp the strike 14. The latch 50 is formed of an elastomeric material such as steel and thus constitutes a leaf spring. Near the curled end 52, the latch 50 has a reduced width so as to clear the embossments 42 and 43 on the arms 35 and 36.

As explained more fully hereinafter, the end portion 55 of the latch 50 also has a reduced width for facilitating the alignment of the latch 50 with the strike 14. The side edges 56 and 57 of the latch 50 are inwardly tapered to engage the sides of the strike 14 to cam the latch 50 into alignment with the strike if the associated door or gate has sagged. In other words, the latching portion or spring has angles cut into the intercepting end. The strike has sides which are indented and contain a radius. The angles on the spring and the configuration of the strike cause the case and the strike to self align when the hasp is closed.

Figure 12:
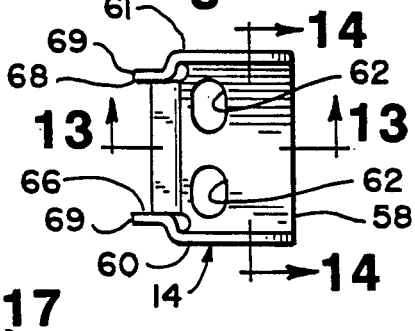
FIG. 12 is a plan view of the strike shown in FIG. 1.
Figure 13:
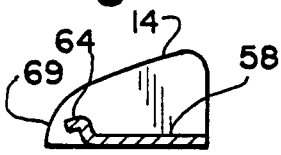
FIG. 13 is a cross-sectional view taken along the line 13—13 of FIG. 12.
Figure 14:
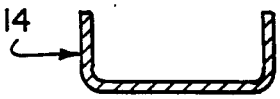
FIG. 14 is a cross-sectional view taken along the line 14—14 of FIG. 12.

The strike 14 is shown in its entirety in FIGS. 12, 13, and 14, and it is shown in combination with the latch sub-assembly 12 in FIGS. 1 and 2. As there shown, the strike 14 comprises a generally planar base or bight portion 58 connected to a pair of upstanding side flanges 60 and 61. A pair of elongated mounting holes 62 are provided in the base portion 58 to receive the mounting fasteners 19. At the end of the base portion 58 remote from the latch sub-assembly the base is reversely bent to provide a hook-like strike element 64 over which the hook at the end of the latch member 50 is adapted to be engaged as shown in FIG. 2. The side flanges 60 and 61 are reversely bent at the locations adjacent to the strike element 64 to provide guide rails 66 and 68 for directing the hooked end of the latch member 50 into engagement with the strike element 64 when the latch is operated to engage the strike element 64. The front ends 69 of the side flanges 60 and 61 are curved to match the adjacent side edges of the latch 50.

As thus far described, it will be seen that the latch 50 and the operating handle 34 cover all of the mounting fasteners 19 and 20 to prevent access thereto when the latch assembly is in the locked position. Also, the handle 34 extends over the portion of the lever 32 from the distal end to a point adjacent the pivot pin 48—see FIG. 2.

Figure 4:
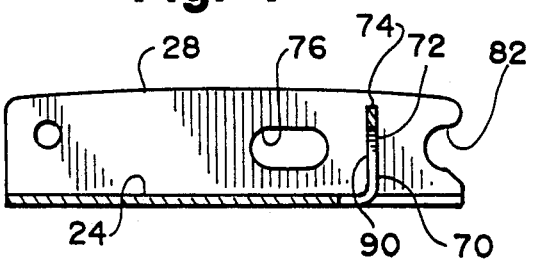
FIG. 4 is a cross-sectional view taken along the line 4—4 of FIG. 3.

In order to accommodate the padlock 21 for locking the latch sub-assembly in the latched position as shown in FIGS. 1 and 2, the base 24 of the case 22 is provided with an apertured, upstanding tab 70 adjacent the distal end thereof, i.e., the end remote from the strike 14. An opening 72 is provided in the tab 70 defined in part by cross wall 74—see FIG. 5. In the illustration given, the tab 70 is struck from the bight 24 and pivoted upwardly as seen in FIG. 4. As can be seen from FIG. 1, aligned openings 76 and 78 are provided in the side flanges 26 and 28 of the case 22 and in the flanges 35 and 36 of the lever 32 to receive the shackle 80 of the padlock 21 (compare FIGS. 2 and 5). In addition, a pair of slots 82 (see FIG. 4) are provided in the rearward ends of the side flanges 26 and 28 for receiving the shackle of the padlock 21 and for guiding the shackle of the padlock into position. Thus, the shackle of a padlock is threaded through three holes. As at 76, 78 and 72. This means that the shackle must pass through three layers of steel, providing greater security.

Operation

In use, the strike 14 and the latch sub-assembly 12 are mounted respectively to the coplanar surfaces of the pair of members 26 and 28 to be latched together so that the latch 50 fits between the guide rails 66 and 68 of the strike 14. To unlatch the latch assembly from the strike member, the handle 34 is pulled away from the base causing the lever 32 to pivot about the axis of the pintle 40 and to push the hooked end of the latch member 50 away from the strike element 64. The latch member can then be lifted away from the strike, and the members 16 and 18 can be moved away from one another.

In order to latch the members 16 and 18 together, the members 16 and 18 are moved into substantially abutting relationship, and the lever 32 is lifted away from the bight of the case 22 thereby positioning the hooked end 55 of the latch member 50 adjacent to the strike element 64 and against the face of the member 18 to which the strike 14 is mounted. The lever is then pivoted to the latching position by moving it toward the bight 22. The hooked end 55 of the latch member 50 is thus pulled under the strike element 64, and because of the elasticity of the latch member 50, any small changes in the relative positions of the members 16 and 18 does not prevent movement of the lever 32 into the fully latched position. Moreover, if the members 16 and 18 are not in actual abutment when the latching lever is moved into the latched position, the latch member 50 pulls the members 16 and 18 together as the lever 32 is pivoted into the latching position. The padlock 21 can then be attached to the latch sub-assembly 12 by inserting the shackle 80 through the openings 76, 78, and 72 and thereafter locking it in place. Inasmuch as the lever handle 34 extends a substantial distance beyond the tab 70, as best shown in FIG. 2, irrespective of the position of the body or case of the padlock, the shackle 80 is substantially covered and protected by the latch sub-assembly, thereby assuring that unauthorized access to the shackle is substantially prevented.

The close proximity of the strike 14 and the case 12 makes it difficult, if not impossible, to insert a prybar or the like between the two, and the close proximity of the sides of the strike and the edges of the latch 50 also make it difficult if not impossible to insert a prybar or the like therebetween. In addition, the upper edges of the sidewalls of the strike 14 have a radius which is the same as the face of the latch. This makes access to the space between the strike and the latch member difficult. Also, the shackle of the padlock extends through the tab 70 and the sides of both the latching lever 32 and the case 22 making it extremely difficult to break the latch itself to remove the padlock therefrom. The hole in the tab is only slightly greater in diameter than the outer diameter of the shackles of the padlocks for which the latch assembly is designed to be used to prevent substantial movement of the padlock relative to the latch assembly. This further prevents the use of a prybar or shackle cutter.

Figure 16:
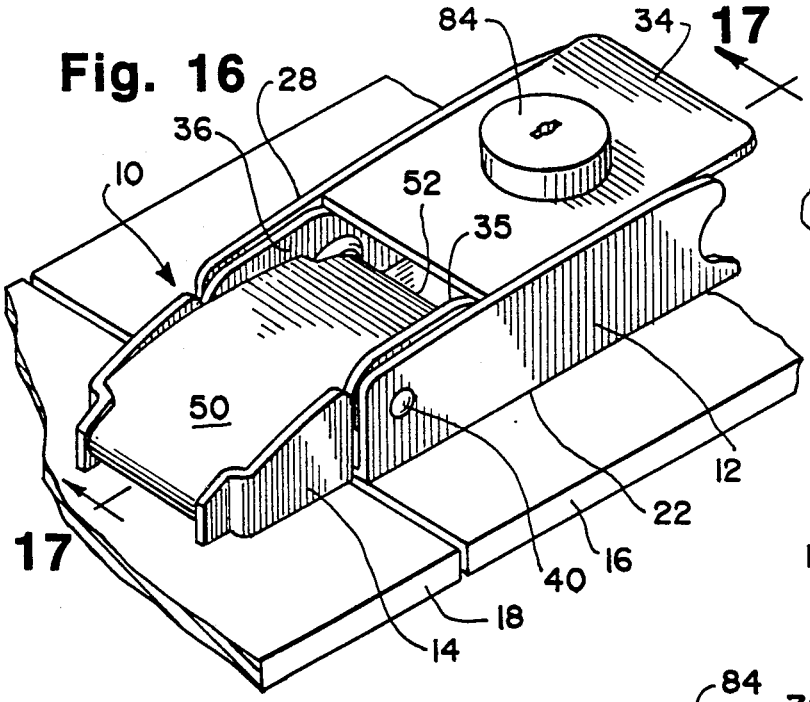
FIG. 16 is an isometric view of another embodiment of the invention.
Figure 17:
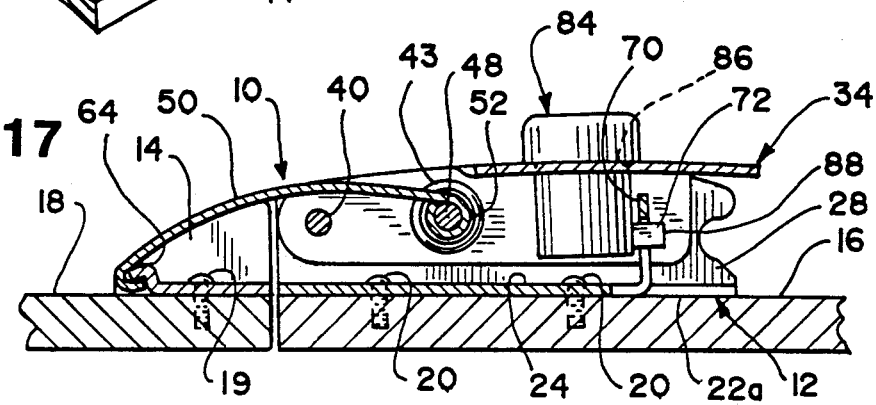
FIG. 17 is a cross-sectional view taken along the line 17—17 of FIG. 16.

Referring to FIGS. 16 and 17 there is shown an alternative embodiment of the invention which is similar in construction to the latch assembly shown in FIGS. 1 and 2 and described above. In FIGS. 16 and 17, like parts have been identified by the same reference numbers used in FIGS. 1 and 2. The case member 22*a* is similar in construction to the case member 22 shown in FIGS. 1 and 2 except that no openings are provided in the sides thereof for receiving the shackle of a padlock. A key lock 84 is mounted in a circular hole 86 in the handle 34 and includes a retractable bolt 88 which extends through the opening 72 in the tab 70 when in the locked position as shown in FIG. 17. When the key lock 84 is unlocked, the bolt 88 is axially withdrawn from the opening 72 in the tab 70 to permit lifting the handle 34 and release of the latch.

An important advantage of the invention resides in the fact that there are openings provided in the case 22 and lever 32 for the receipt of a lock member, i.e., the shackle of a padlock 21 or the bolt 88 of a key lock 84. As can be appreciated from a consideration of FIGS. 1 and 16, the opening in the lever 32 can be either in the handle portion 34 (FIG. 16) or the sidewall 35 or 36—and with the opening in the case 22 being in the just described tab 70. Tab 70 is advantageously disposed in a plane normal to the sidewalls or flanges 26, 28, but need not necessarily be upstanding from the bight or base 24. Alternatively, the tab 70 may be developed by upsetting one of the sidewalls or flanges 26, 28—the invention only contemplating that there be a solid apertured part of the case able to cooperate with an apertured part of the lever in receiving the operative parts of a lock. In the instant invention, the top of the assembly provides a covered area permitting direct access to the shackle of a padlock, thereby preventing bolt cutters or other cutting devices from cutting the shackle. By the same token, the top prevents destruction of the key lock 84 inasmuch as access to the lock bolt 88 is again prevented.

FEATURES PREVENTING UNAUTHORIZED ACCESS

Figure 2A:
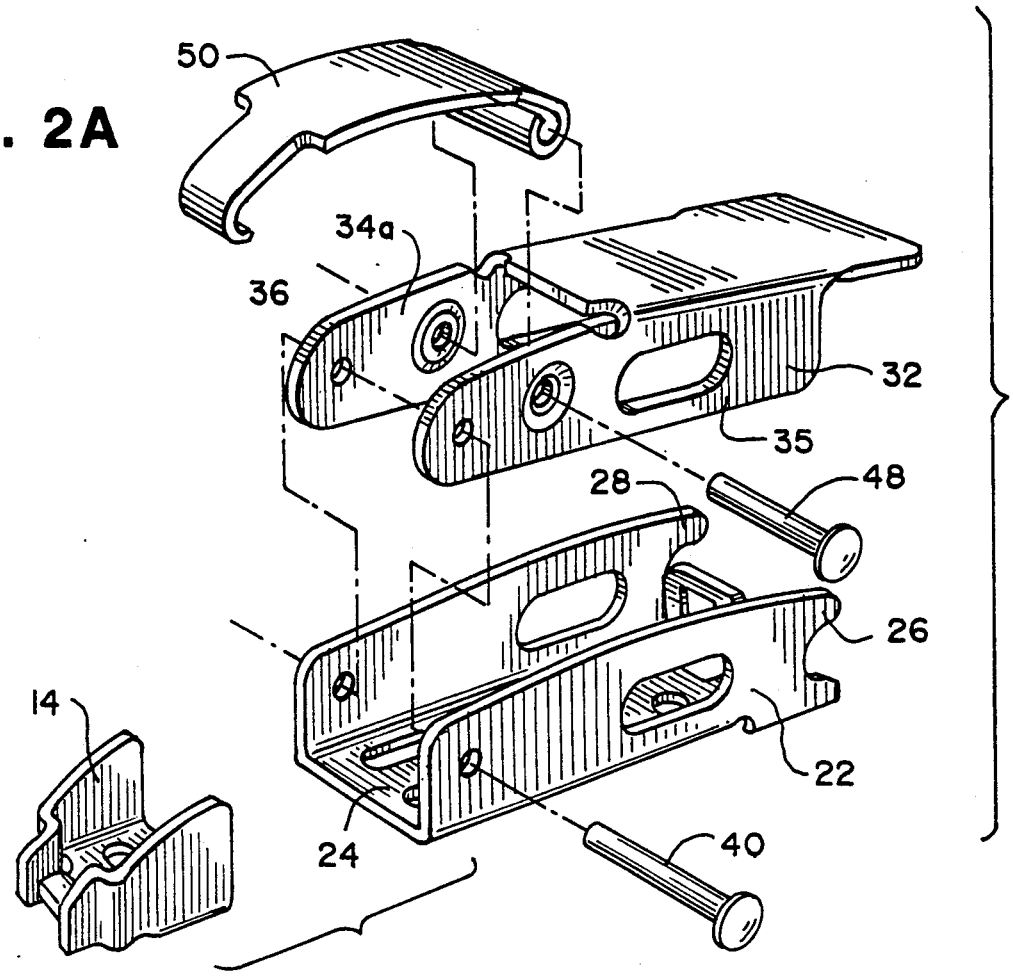
FIG. 2A is an exploded view of the latch assembly and strike of FIG. 1.
Figure 2B:
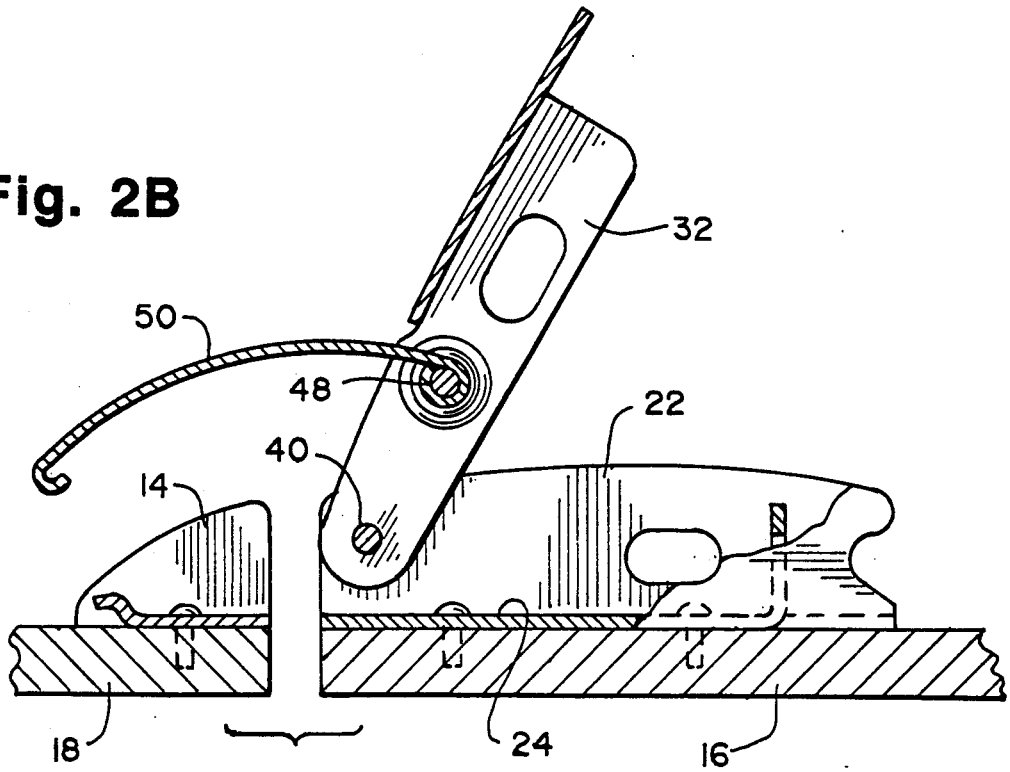
FIG. 2B is a side elevational view of the sub-assembly and strike in unlatched position.

The areas an intruder would seek to open consist of the top, two sides and two ends of the latch assembly 10, viz., the combination of sub-assembly 12 and strike 14. As mentioned previously, this assembly now has the appearance of a rectangular solid—due to the nesting of the latch 50 within the lever 32 and strike 14, and the nesting of the lever 32 within the case 22. It is the nesting feature that is the principal protection against unauthorized access. The nesting can be especially appreciated from a consideration of the exploded view FIG. 2A.

There, the outer receptacle is the one shown in the lowest position, i.e., the case 22. As pointed out previously, this is relatively elongated and generally U-shaped in transverse section. More particularly, the upstanding sidewalls or flanges 26, 28 are connected by a transverse base or bight 24. Nested within the case 22 is the lever 32 which again is relatively elongated and also of general U-shape in transverse section. The flanges or arms defining this U-shape are dependent as at 35, 36 and are connected adjacent the end remote from the strike 14 by the handle 34 which serves as a connecting portion or bight. Thus the U-shape of the lever 32 is inverted and the only area of the two element combination of the case 22 and the lever 32 that could be accessible is the portion 34*a* of the top wall omitted at the proximal portion of the lever 32.

However, this open portion 34*a* in the top of the lever 32 is effectively closed by the latch 50 so that there is provided the rectangular solid which is essentially tamper-proof. More particularly, the spatial arrangement of the parts frustrates a would-be burglar using a pry bar, screw driver or the like.

The feature of the spatial arrangement can be appreciated from a consideration of FIG. 1, for example, where the spacing between adjacent walls as at 36 on the lever 32 and 28 on the case 22 is less than the thickness or gauge of the metal making up the various parts of the latch assembly. Thus, the would-be burglar would be limited to a tool having lesser thickness than the walls sought to be deformed. This automatically introduces automatically an advantageous factor of safety against deformative rupture of the inventive latch assembly.

Another advantageous feature made possible by the nesting configuration just described is that the pivot pin 48 securing the latch 50 to the lever 32 is entirely confined within the generally rectangular solid made up of the latch 50, lever 32 and case 22. In many instances in the past, where the pivot pin was accessible from the outside, it could be drilled open whereupon the latch assembly could be unlatched. This is not the case with the instant invention. Notwithstanding the fact that the pintle 40 can be accessed from the exterior, the destruction of this by drilling from the outside would not affect the latch arrangement which remains intact.

Figure 5:
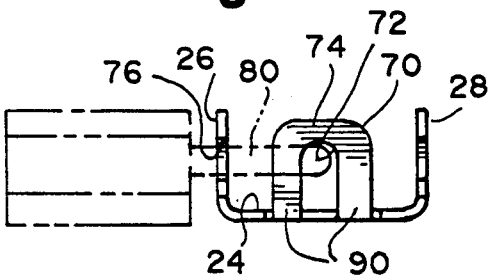
FIG. 5 is an end view of the case taken from the right side of FIG. 4.
Figure 6:
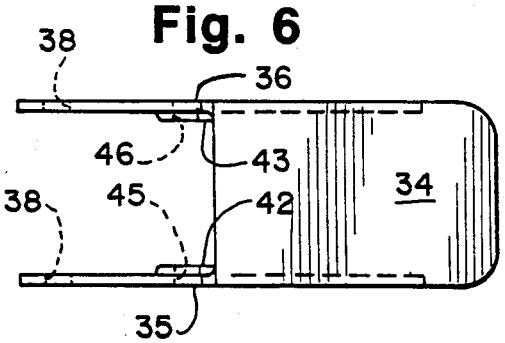
FIG. 6 is a plan view of the operating handle of the latch assembly shown in FIG. 1.
Figure 8:
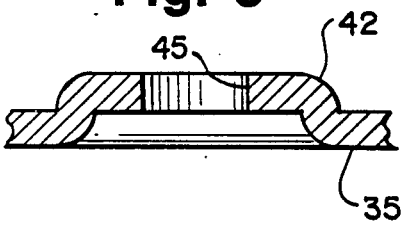
FIG. 8 is a cross-sectional view taken along the line 8—8 of FIG. 7.
Figure 7:
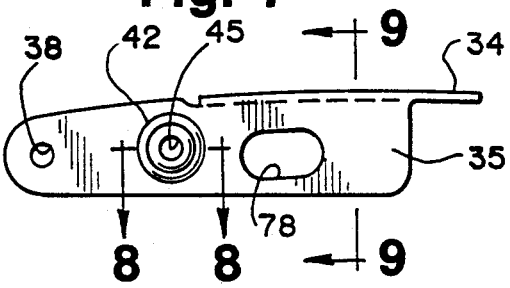
FIG. 7 is a bottom view of FIG. 6.
Figure 9:
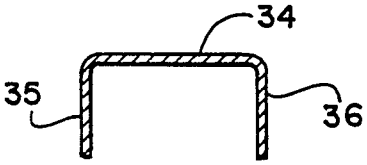
FIG. 9 is a cross-sectional view taken along the line 9—9 of FIG. 7.

Experience has shown that a frequent target for a burglar is the distal end 10*a* of the latch assembly 20—see FIG. 2. The object has been to rupture the upstanding tab 70. This is particularly true in the case of a keylock (see FIGS. 16 and 17). However, here we have provided an especially strong upstanding part or lock tab 70. More particularly, the tab 70 (see FIG. 5) is defined by an upstanding plate-like portion having an opening 72 therein defined by a top wall portion 74 and sidewall portions 90. These all have widths at least as great as the thickness of the tab itself, thereby again frustrating any illegal entry. The relative sizes have been exaggerated but can be appreciated from a comparison of the tab 70 in the substantial width of the portion 74 in the FIGS. 4 and 5 showings.

One of the deterring features at the top of the assembly 10 is the previously mentioned small clearances between the parts which resist the intruder's use of a prying tool bar less thick (and therefore, less strong) than the parts being asaulted. These clearances are those between (1) the case and lever and (2) the latch and case/strike.

Still focusing on the top of the assembly 10, there is an opening 10*b* (see FIG. 2 in the upper central portion thereof) which is defined by the distal end of the latch 50 and the proximal end of the lever 32, more particularly, the handle 34. For a prying action to be successful here, the force must be sufficient to rupture either the pivot pin 48 or the pintle 40. These are especially strong—having diameters greater than the gauge of the metal supporting them and it is normally difficult to provide enought leverage to affect these.

This same deterrence applies to the small gaps at 10*c* (see the left hand end of FIG. 1) where no sizeable prying tool could be inserted.

Further, any attempt to destroy the latching mechanism by inserting a prying tool thorugh the proximal end 10*d* (see FIG. 1) is frustrated through the provision of the arcuate, spring-like latch 50. In the past, interloper action has been centered on destroying or deforming the strike element 64 (see FIG. 13) or the curled back end 55 of the latch 50 (see FIG. 11). Such attempts result only in attempting to deform the spring further which results in even tighter gripping of the latch, lever, case and strike.

As to the sides, when the spring is in its over center position, the spring is elongated and shielded by the sides of the case and the side of the strike. This prevents direct side access to the spring and prevents cutting or prying. In keeping with the nested nature of the case lever and latch, the sides of the strike rise to cover the latch or spring locking device. These sides then further complete the appearance of a generally rectangular solid making the overall latch assembly virtually impenetrable to the normal prying tool. The overall product is designed in such a way that when properly mounted the case unit and the strike are located close together, very little gap is provided. The small gap insures that there is little space with which to insert a tool which may cut prior to defeat device in any way.

While the present invention has been described in connection with a particular embodiment, it will be understood that those skilled in the art may make many changes and modifications thereto without departing from the true spirit and scope of the invention. Therefore, it is intended by the appended claims to cover all such changes and modifications which come within the true spirit and scope of the present invention.

I claim:

1. A latch assembly for latching a first member to a second member comprising a relatively elongated latch sub-assembly and a strike, said latch sub-assembly being adapted to be mounted on one member and said strike on the other member in longitudinally aligned relation, said latch sub-assembly having a proximal end adapted to be positioned adjacent said strike and a distal end remote therefrom said latch sub-assembly including in nested relation a case, a lever and a latch, each of said base and lever being U-shaped in transverse section, said lever having a handle bight and two side flanges depending therefrom, pintle means pivotally mounting said lever in said case adjacent the proximal end thereof with the lever side flanges being within the case flanges, a longitudinally arcuate leaf spring latch having a pair of sides, a hook adjacent the proximal end thereof and a pivot mounting adjacent the distal end thereof, pin means pivotally mounting said latch in said lever intermediate the ends thereof, said pintle means and pin means cooperating to develop over center action in said lever, said handle bight extending from the lever distal end to a position adjacent said pin means, said strike also having upstanding side flanges, the lever side flanges having proximal ends adjacent the distal ends of said strike side flanges, said strike flanges and lever flanges being in covering relation to said latch sides, and lock means adjacent the distal end of said case for releasably locking said case and lever together in nested relation and for preventing pry bar use by an intruder.

2. The latch assembly according to claim 1 in which said strike adjacent the proximal end thereof has longitudinally straight side flanges upstanding from a bight and in which the side edges of said latch adjacent said hook are longitudinally tapered for engaging said strike said flanges to guide said latch into latching position between said strike side flanges.

3. The latch assembly of claim 1 in which the spacing between adjacent flanges of the case and lever is less than the thickness of said flanges, the spacing of said latch from the upstanding flanges of said strike being less than the thickness of said latch.

4. A latch assembly for latching a first member to a second member, comprising in combination:

a case adapted to be mounted to said first member, said case including a bight and two upstanding side flanges, a strike adapted to be mounted to said second member, a lever pivotally mounted on said case and disposed between said side flanges, a latch in the form of a leaf spring, and means pivotally mounting said latch to said lever, said latch having a hooked end portion for selective engagement with said strike to latch said first and second members together, fastener means attaching said strike to said second member, said latch covering said fastener means when said latch is engaged with said strike, said latch and said lever being pivotally mounted for respective pivotal movement about mutually parallel axes, an upstanding part of said case having an opening therethrough for receiving the shackle of a padlock, and an opening in said lever for receiving said shackle when said latch is in the latching condition, and said upstanding part of said case being generally planar, located midway between said case side flanges and lying in a plane perpendicular to said case side flanges.

5. The latch assembly of claim 4 in which said case has a distal end remote from said strike, said case upstanding side flanges being equipped with notches at the distal ends thereof for receipt of said shackle.

* * * * *